United States Patent [19]

Nowaczyk

[11] Patent Number: 4,716,726

[45] Date of Patent: Jan. 5, 1988

[54] ADJUSTABLE ROTARY VANE PUMP

[76] Inventor: David J. Nowaczyk, 3024 W. 40 Pl., Chicago, Ill. 60632

[21] Appl. No.: 838,774

[22] Filed: Mar. 12, 1986

[51] Int. Cl.[4] ..... F16D 39/00

[52] U.S. Cl. ..... 60/487; 60/491; 418/13; 418/30

[58] Field of Search ..... 60/487, 491; 418/13, 418/16, 30

[56] References Cited

U.S. PATENT DOCUMENTS

| | | | |
|---|---|---|---|
| 1,773,211 | 8/1930 | Wilsey | 418/16 |
| 3,808,814 | 5/1974 | Macy II | 60/487 |
| 4,109,466 | 8/1978 | Keech | 60/487 |

FOREIGN PATENT DOCUMENTS

| | | | |
|---|---|---|---|
| 454548 | 2/1949 | Canada | 418/16 |

*Primary Examiner*—A. Michael Chambers

*Attorney, Agent, or Firm*—William J. Michals

[57] ABSTRACT

An adjustable rotary vane pump for changing the direction and rate of fluid flow through the pump. The pump comprises a first pump housing having a generally cylindrical chamber therein along a central axis of the housing. A second housing is provided having a second chamber therein coaxially oriented with the first housing. An insert member is provided in the second housing having an aperture therein of a given eccentricity. The insert member is slidably adjustable for rotational movement within the second housing for providing varying cross-sectional dimensions for the fluid flow through the pump. A rotor is disposed in the housing coaxial with the first and second housing. A plurality of vane members are provided on the rotor which respectively engage the walls of the first chamber and the insert member within the pump.

5 Claims, 15 Drawing Figures

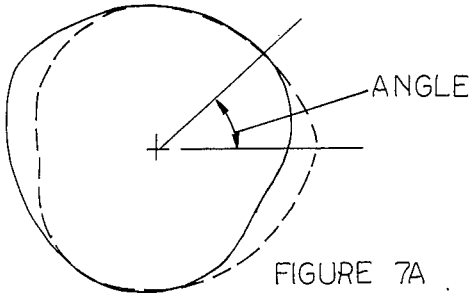
FIGURE 7A
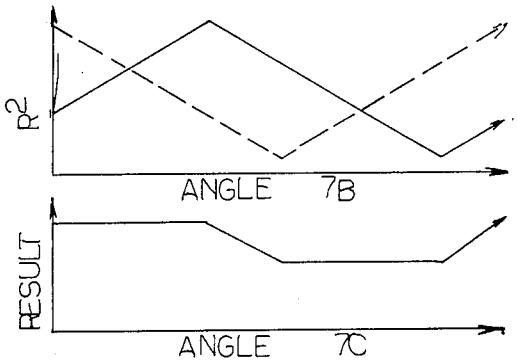
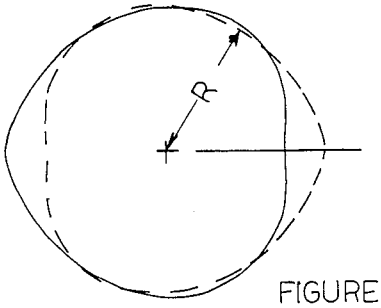
FIGURE 8A
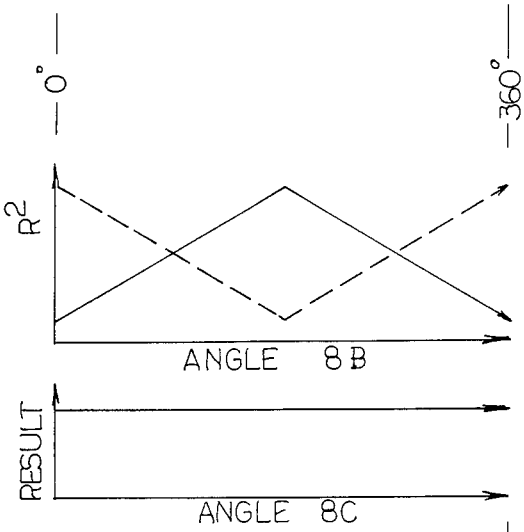
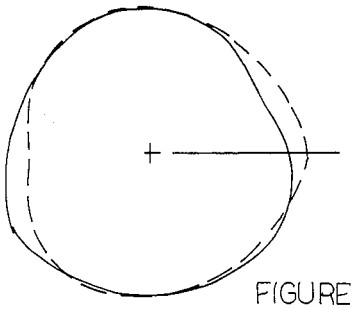
FIGURE 9A
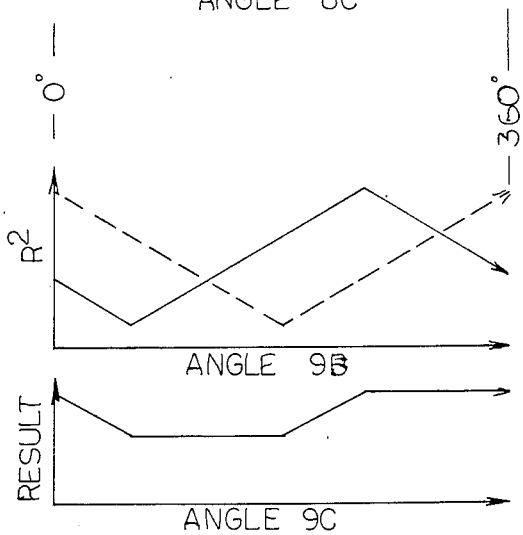

ADJUSTABLE ROTARY VANE PUMP

BACKGROUND OF THE INVENTION

This invention relates to an adjustable rotary vane pump or motor for changing the direction and rate of fluid flow therethrough.

Adjustable rotary vane pumps are known and have been widely used in the art. These devices generally utilize means for altering or varying the size of the chambers which engage the flexible vanes at the circumferential ends of the pump rotor. The control provided by the prior art devices are generally limited to control in a specific direction and generally do not provide complete control of the fluid flow in both directions and at intermediate flow rates.

These and other disadvantages are overcome by the present invention wherein there is provided an adjustable rotary vane pump for changing the direction and the rate of the fluid flow through the pump in response to a simple adjustment to a pump member.

It is an object of the present invention to provide a variable volume of flow of a fluid as a function of rotation of an input shaft. It is also an object to provide a given amount of a shaft rotation from a given amount of fluid flow.

SUMMARY OF THE INVENTION

Briefly, the present invention provides an adjustable rotary vane pump for changing the direction and rate of fluid flow through the pump. The pump comprises a first pump housing having a generally cylindrical chamber therein along a central axis of the housing. A second housing is provided having a second chamber therein coaxially oriented with the first housing. An insert member is provided in the second housing having an aperture therein of a given irregular shape or eccentricity. The insert member is slidably adjustable within the second housing for providing varying cross-sectional dimensions for the fluid flow through the pump. A rotor is disposed in the housing coaxial with the first and second housings. A plurality of vane members are provided on the rotor which respectively engage the walls of said first chamber and said insert member within the pump.

A preferred embodiment comprises a first section of a fixed volume type vane pump with the addition of a second section that is placed alongside the first, thereby allowing fluid to pass between the two. The vanes are arranged so as not to let fluid pass across the vanes within the two housings, but only through ports in the housings and between the two housings within the vane spacing. The variable output is controlled by the relative angular positioning of the housings to produce the desired flow or shaft rotation.

BRIEF DESCRIPTION OF THE DRAWING

The advantages of this invention will become completely understood by reference to the following detailed description when taken in conjunction with the accompanying drawing wherein:

FIGS. 7A, 7B and 7C illustrate the housing arrangement providing a forward flow through the pump in accordance with the principles of the present invention;

FIGS. 8A, 8B and 8C are similar to the Figures illustrated in FIGS. 7A–C but which illustrate the housing arrangement in accordance with the present invention in the no-flow position; and, FIGS. 9A, 9B and 9C are illustrations similar to those of FIGS. 7A–C and 8A–C but which illustrate the device in the reverse flow mode.

DETAILED DESCRIPTION

Figure 1:
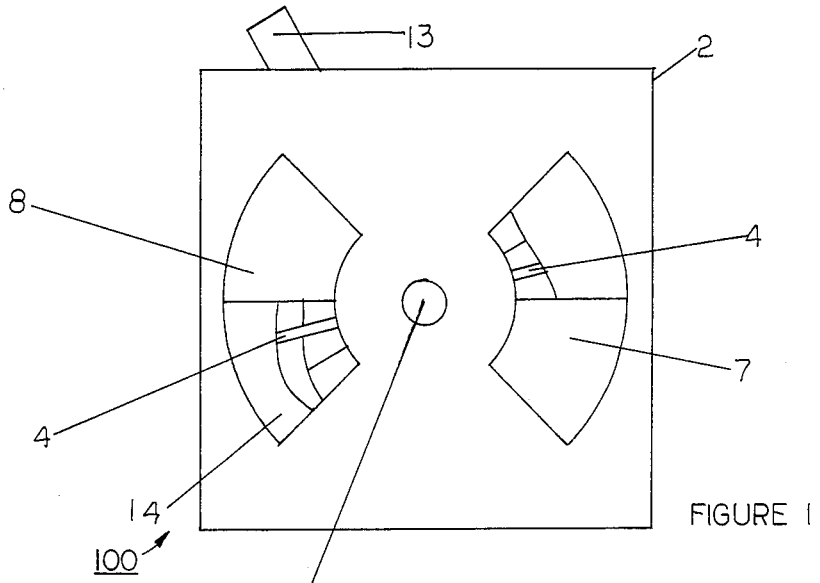
FIG. 1 is a top view of the pump assembly in accordance with the principles of the present invention illustrating the inlet and outlet ports.
Figure 2:
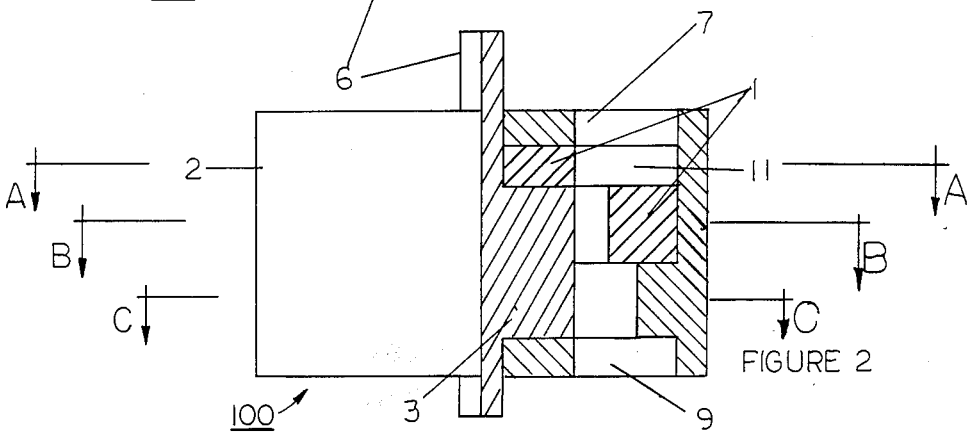
FIG. 2 is a side view of the pump in partial cross-section illustrating the path in which the fluid flows between the respective housing portions and through the variable port to the inlet ports.
Figure 3:
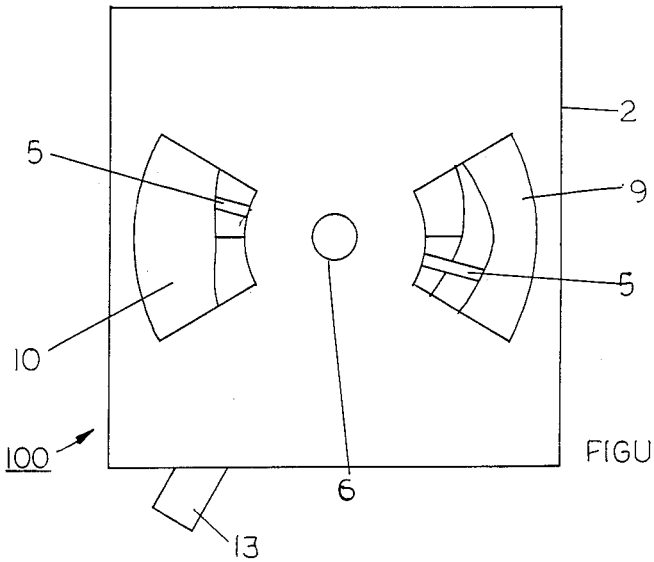
FIG. 3 is a bottom view of the pump assembly illustrated in FIGS. 1 and 2.
Figure 4:
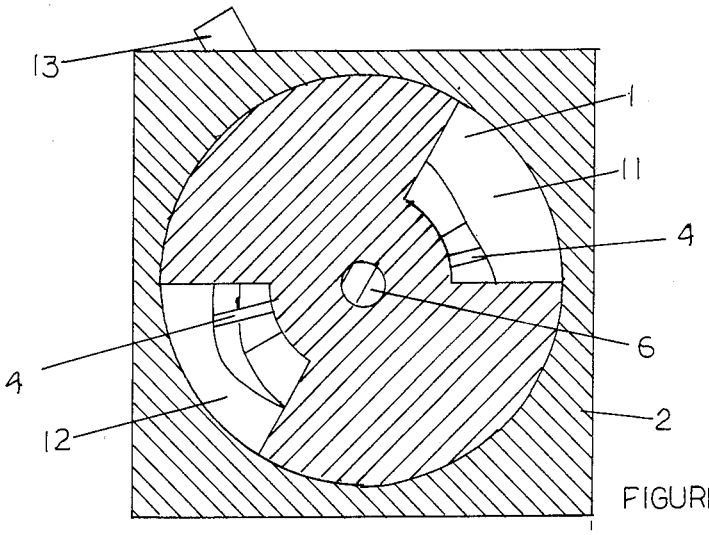
FIG. 4 is a sectional view taken along line A—A of FIG. 2 illustrating the port positioning within the housing.

Referring now to FIGS. 1, 2 and 3 there are shown generally at 100 an adjustable vane pump assembly in accordance with the principles of the present invention.

Figure 5:
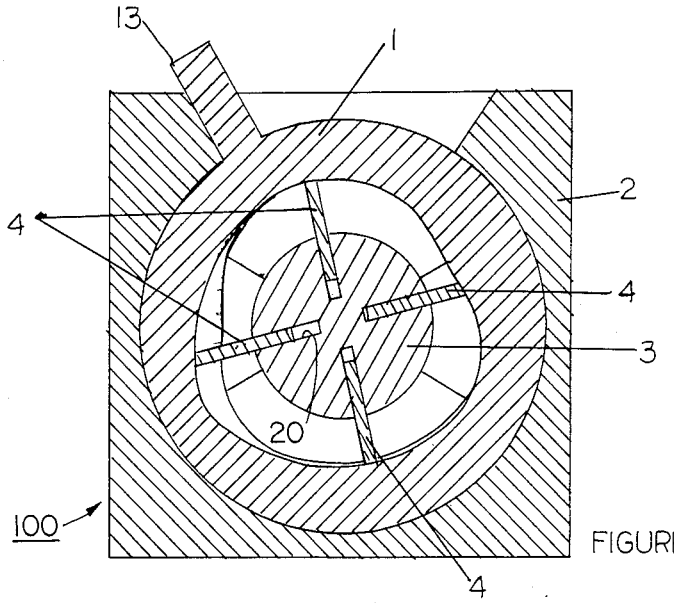
FIG. 5 is a sectional view taken along the line B—B of FIG. 2 illustrating, more particularly, the rotor and variable housing surfaces of the previous drawing figures.
Figure 6:
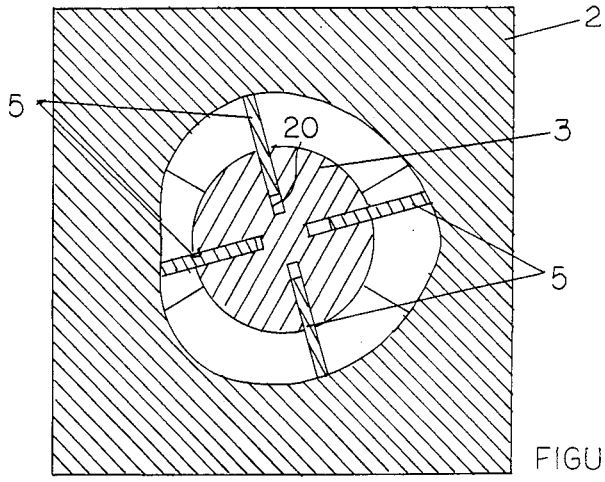
FIG. 6 is a sectional view taken along the line C—C of FIG. 2 illustrating the structural arrangement of FIG. 2.

The basic components illustrated in FIGS. 1–3 are in themselves well known in the art and have formed components of known vane pumps. Shaft 6 is rotated or has torque applied thereto by an external source in the case of a pump and provides the power source in the application of the rotary vane pump when used as a motor. Shaft 6 is an integral part of or is fixed to rotor 3 so as to function in a unitary fashion. Rotor 6 includes a plurality of slots 20 as best illustrated in FIG. 5. Slots 20 receive a plurality of vane members 4 and 5 which are spring-loaded in a radially outward direction by resilient spring means (not shown). Vanes 4 and 5 are slidably mounted within slots 20 so as to engage the corresponding wall portions of the radially outwardly wall chambers of the respective housings 1 and 2. Vanes 4 and 5 provide a fluid seal between the center of the rotor 3 and the corresponding walls of the respective chambers within housings 1 and 2. Vanes 4 and 5 maintain this seal during rotation of rotor 3 by means of the spring-loaded devices or the outwardly directed dynamic forces on the vane during the operation of vane pump 100. The respective housings are provided of a predetermined width corresponding to the width of the vanes. The respective housings are provided with the following varying radii, as a function of angle in degrees, and are defined by the following equations wherein r is the radius of the housing at a given angle $\theta$ which is the angular rotation of rotor 3 and shaft 6 with regard to a given reference point or radius.

$$0 \leqq \theta \leqq 180^\circ \qquad r = (a + b\theta)^{\frac{1}{2}}$$

$$180^\circ \leqq \theta \leqq 360^\circ \qquad r = (c + d\theta)^{\frac{1}{2}}$$

In the above equations, a, b, c and d are dimensioned constants and are selected to provide the design of a given pump. The two housings are rotated 180° apart from one another to provide the relationship as illustrated in FIGS. 8A–C. In actual practice adjustments or additions are made to the radius described above to meet the needs of a given application. For example, additions can be made so as to allow a smooth curve at the 0° and 180° thereby to reduce noise in the operation of the vane pump and to allow the vanes to maintain contact with the housings at all times. Secondly, two full wavelengths are used under high pressure conditions instead of a single wavelength as shown so as to provide a hydraulic balance condition. In other applications still additional wavelengths may advantageously be utilized. The variable housing 1 includes variable ports 11 and 12. These ports are provided at the side of the variable housing 1 and are rotated when housing 1 is rotated by means of lever 13 to vary the flow.

The operation of the method and apparatus in accordance with the principles of the present invention through one cycle thereof are described as follows in conjunction with FIGS. 7, 8 and 9. In these figures, the broken line represents the fixed housing whereas the solid line represents the variable housing. The flow resulting from the variable, relative positions of the housings are represented by FIGS. 7C, 8C and 9C. A volume of fluid enters the pump through ports 7 and 9 from an external passageway (not shown). Fluid will flow from port 7 through port 11 to the space between the vanes 4, 5. Fluid from port 9 will enter this space directly. This space is increased in volume as shown in FIG. 7C. The position at this point is at the end of the graph where the line exhibits and upward slope. The rotor 3 is rotated while vanes 4 and 5 containing this volume are pushed radially outwardly by the spring-loaded devices in slots 20 of the rotor 3. Vane 4 in housing 1 is held in contact with housing 1. Vane 5 is held in contact with the fluid housing 2 in a manner similar to vane 4 of housing 1 by the spring loaded vanes in slots 20 or by the dynamic forces on the vanes resulting from the operation of vane pump 100. As the rotation continues, vanes 4 and 5 will pass the opening of ports 7, 9 and 11 and thereby be sealed from any passage in which fluid can escape from this contained volume. During this rotation the volume between the vanes will remain constant. This is shown by FIG. 7C by the flat portion of the curve. This flat portion is accomplished by one housing increasing in size and the second housing decreasing in size and therefore its corresponding volume. The size of the volume is controlled by the shifting of the two housings (one of increasing volume and the second of decreasing volume) to attain the desired volume size. This can readily be seen in FIGS. 7, 8 and 9 as the housings are shifted in the positive rotation direction which is counterclockwise in the top views provided. A positive flow direction as illustrated in FIG. 7; a no fluid flow condition is illustrated in FIG. 8; and, a reverse fluid flow direction is illustrated in FIG. 9.

When the leading vanes 4 and 5 enter the section in which the outlet ports 10 and 12 are provided, the volume is no longer sealed and, instead, is provided with passageways to the outlet port. When this condition occurs, as when set to the forward fluid flow direction, the volume decreases in size. As this occurs, a portion of fluid contained is forced out through ports 10 and 12. The fluid flow will pass from port 12 through port 8 and when combined with the flow from port 10 will enter the outlet passageway (not shown). As rotation of shaft 6 continues, the vanes 4 and 5 will seal off the reduced volume from the outlet ports. At this point, the volume will remain constant as illustrated in FIG. 7C and, more particularly, at the second flat portion thereof. At this point the cycle is repeated.

The shifting of the housings is controlled by lever 13 to rotate variable housing 1. Attached to variable housing 1 are the variable ports 11 and 12. These variable ports increase the pump working range and function to keep the port open to the non-flat or sloped sections of the operation of the vane pump as best illustrated in FIGS. 7C and 9C.

What has been taught, then is an adjustable rotary vane pump mechanism for changing the direction and rate of fluid flow through the valve. The form of the invention illustrated and described herein is but a preferred embodiment of these teachings. It is shown as an illustration of the inventive concepts, however, rather than by way of limitation and it is pointed out that various modifications and alterations may be indulged in within the scope of the appended claims.

What is claimed is:

1. An adjustable rotary vane pump or motor device for changing the direction and rate of fluid flow therethrough, said device comprising, in combination:

a first pump housing having a first chamber therein extending along a central axis of said housing said first housing having an inlet and an outlet respectively opening into said chamber;

a second pump housing mounted adjacent said first housing and having a second chamber therein extending along said axis and being generally coaxial with said first chamber;

an insert member received within and slidably mounted in said second chamber for rotational movement about said axis, said insert member having an aperture therein and extending therethrough along said axis and wherein the cross section of said aperture is of a predetermined irregular shape;

a rotor coaxially mounted in said housings and extending through said aperture and said first chamber;

a first plurality of vanes mounted on the portion of said rotor extending through said first chamber and extending radially away from said axis for engaging the wall portions of said first chamber; and a second plurality of vanes mounted on the portion of said rotor which extends through said aperture for engaging the wall portions of said aperture.

2. The rotary vane device according to claim 1 wherein the cross section of said first chamber is of a predetermined irregular shape.

3. The rotary vane device according to claim 2, wherein said second chamber is generally cylindrical and wherein the cross sections of said second chamber and the radially outwardly facing surface of said insert member are circular.

4. The rotary vane device according to claim 2 wherein said insert member is slidably adjustable to at least three angular positions wherein a first of said positions provides fluid flow through said pump in a first direction, wherein a second of said positions provides fluid flow through said pump in a second direction oppoite to said first direction and wherein the third position stops the flow of fluid through said pump.

5. The rotary vane device according to claim 1, wherein said predetermined irregular shape is a given eccentricity.

* * * * *